US011566388B2

(12) United States Patent
Forsat et al.

(10) Patent No.: US 11,566,388 B2
(45) Date of Patent: Jan. 31, 2023

(54) ROAD MARKER DE-ICING DEVICE

(71) Applicant: QATAR UNIVERSITY, Doha (QA)

(72) Inventors: Masoud Forsat, Doha (QA); Seyed Sajad Mirjavadi, Doha (QA); Abdel Magid Hamouda, Doha (QA)

(73) Assignee: QATAR UNIVERSITY, Doha (QA)

( * ) Notice: Subject to any disclaimer, the term of this patent is extended or adjusted under 35 U.S.C. 154(b) by 476 days.

(21) Appl. No.: 16/739,281

(22) Filed: Jan. 10, 2020

(65) Prior Publication Data

US 2021/0214903 A1 Jul. 15, 2021

(51) Int. Cl.
*E01F 9/40* (2016.01)
*E01F 9/553* (2016.01)

(52) U.S. Cl.
CPC ..... *E01F 9/40* (2016.02); *E01F 9/553* (2016.02)

(58) Field of Classification Search
CPC ..... E01F 9/00; E01F 9/40; E01F 9/553
See application file for complete search history.

(56) References Cited

U.S. PATENT DOCUMENTS 3,164,071 A 1/1965 Rubenstein
5,013,180 A * 5/1991 Ko ..... E01F 9/40 404/9
D520,394 S 5/2006 Li et al.
7,211,771 B1 * 5/2007 Smith ..... E01F 9/40 116/202
8,152,325 B2 * 4/2012 McDermott ..... E01F 9/559 362/153.1
10,253,468 B1 * 4/2019 Linville ..... E01F 9/40
2005/0244225 A1 * 11/2005 Jordan ..... E01F 9/559 404/16
2014/0197955 A1 7/2014 Martin et al.
2016/0046262 A1 2/2016 Vanstraten

FOREIGN PATENT DOCUMENTS

DE 102007003408 A1 12/2008
GB 2 299 358 A 2/1996
KR 100714081 B1 5/2007

OTHER PUBLICATIONS

Thom Patterson, "Solar-Powered 'Smart' Roads Could Zap Snow, Ice", CNN, Jan. 19, 2011, 3 pages.

* cited by examiner

*Primary Examiner* — Quan Zhen Wang
*Assistant Examiner* — Mancil Littlejohn, Jr.
(74) *Attorney, Agent, or Firm* — Squire Patton Boggs (US) LLP

(57) ABSTRACT

A road marker may include a housing with a cavity and at least one perimeter surface oriented perpendicular to the direction of traffic. Each of the at least two perimeter surfaces containing an opening may be substantially covered with a mesh. Further, each of the openings may form either an air input or an air output, and the air input and air output openings may be located substantially opposite to each other to generate a flow of air through the cavity. In addition, the cavity may include passive electrical components for heating the flow of air.

7 Claims, 6 Drawing Sheets

ROAD MARKER DE-ICING DEVICE

FIELD OF THE INVENTION

The present invention relates generally to a road marker, and in particular to a road marker with a fan and heating apparatus that is used to remove snow from travel surfaces.

BACKGROUND OF THE INVENTION

Retroreflective safety devices for roads or road markers, commonly known as cat eyes, are used worldwide to manage traffic and maintain roadway safety. These markers generally include reflective material, visible both during the day and at night on exposure to light from street lamps or vehicle headlights. Road markers are widely used as they are inexpensive to produce, simple to install and need little or no maintenance yet still perform a very helpful function for motorists. Vehicle tires require friction (or traction) between the tire and the road to stop or decelerate a vehicle. During inclement winter weather, precipitation reduces the friction on the roadways, and the reduced friction between the tire and roadway will cause the tire to skid, especially when the vehicle is attempting rapid deceleration. Accordingly, snow is ordinarily removed from travel surfaces, such as roads, runways, driveways, bridges, parking lots, and the like for safety and improved travel conditions for vehicles. Generally, snow is removed with a snowplow, a shovel, a blower, an auger, a broom, heating wires underneath the travel surface, sand, salt or a combination thereof. A drawback of these conventional approaches is that they increase wear and tear to the travel surface, thereby increasing the required maintenance for such travel surfaces. For example, with the addition of salt and/or sand to a travel surface, the salt will wash away after a period of time, but the remaining sand may erode the road's asphalt over time. Accordingly, there is a need for an improved travel surface deicing apparatus that results in minimal or no additional road maintenance with its continued use.

SUMMARY OF THE INVENTION

The problems presented by existing travel surface deicing approaches are solved by the systems and methods of the illustrative embodiments described herein.

One embodiment may be directed to a road marker. The road marker may include a housing with a cavity and at least one perimeter surface oriented perpendicular to the direction of traffic. Further, each of the at least two perimeter surfaces containing an opening may be substantially covered with a mesh. In addition, each of the openings may form either an air input or an air output, and the air input and air output openings may be located substantially opposite to each other to generate a flow of air through the cavity. Further, the cavity may include passive electrical components for heating the flow of air. The road marker may also include a circuit board with a plurality of terminals. The road marker may further include a power source coupled to a first input terminal for powering the passive electrical components. The road marker may also include a low temperature bi-metallic sense switch electrically connected to a moisture sensor, and the moisture sensor may be electrically coupled to a second input terminal. The low temperature bi-metallic sense switch may be operable to close upon sensing a predetermined temperature range and to activate the moisture sensor, and when water is detected in an ambient environment around the marker, the moisture sensor may be operable to generate a second signal that is transmitted to the circuit board. The road marker may also include a fan arranged within the cavity between the air input and the air output openings, which may be connected to a first output terminal. The fan may receive a first activation signal from the circuit board. The fan and heating elements may work together, and it may happen when both a temperature sensor and a moisture sensor have activated, which means the second signal from the circuit. Further, the fan may be operable to draw a flow of air into the housing through the air input into the cavity. The road marker may further include one or more heating elements arranged on opposite sides of the fan within the housing, which may be connected to a second output terminal. The one or more heating elements may receive a second activation signal from the circuit board and the heating element may heat the air flow as it exits the housing through the air output opening. Additionally, the road marker may include a high temperature bi-metallic sense switch electrically connected to a third input and operable to close upon sensing a high temperature and to send a signal to the circuit board for deactivating the fan and the one or more heating elements.

Other objects, features, and advantages of the illustrative embodiments will become apparent with reference to the drawings and detailed description that follow.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF ILLUSTRATIVE EMBODIMENTS

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

As previously noted, the application broadly relates to a road marker with multiple input sensors for detecting snow or precipitation within proximity of such marker, and activating a fan and heating element to melt the snow or precipitation within proximity of the road marker. As used herein, the term PV or photovoltaic module refers to a photovoltaic module including a plurality of solar cells, also known as a solar cell array. Photovoltaic modules generate electrical power by converting solar radiation to direct current (DC) electricity.

As used herein, the terms "traffic delineators", "raised pavement markers", "road markers", "road reflectors", "cat eyes" or "road studs" or grammatical variations thereof may be used interchangeably to describe a reflective device on a substrate such as the surface of a road used to alert drivers to changes in road conditions associated with cold temperatures. As used herein, the term "ambient temperature" refers to the temperature immediately around the marker housing. In the context of this application, the term "precipitation" includes precipitation during the winter months. Some examples of precipitation include without limitation, snow, fog, freezing rain, freezing drizzle, sleet, and hail. The precipitation can be blowing precipitation, natural precipitation, or a combination of a blowing and natural precipitation.

Figure 1:
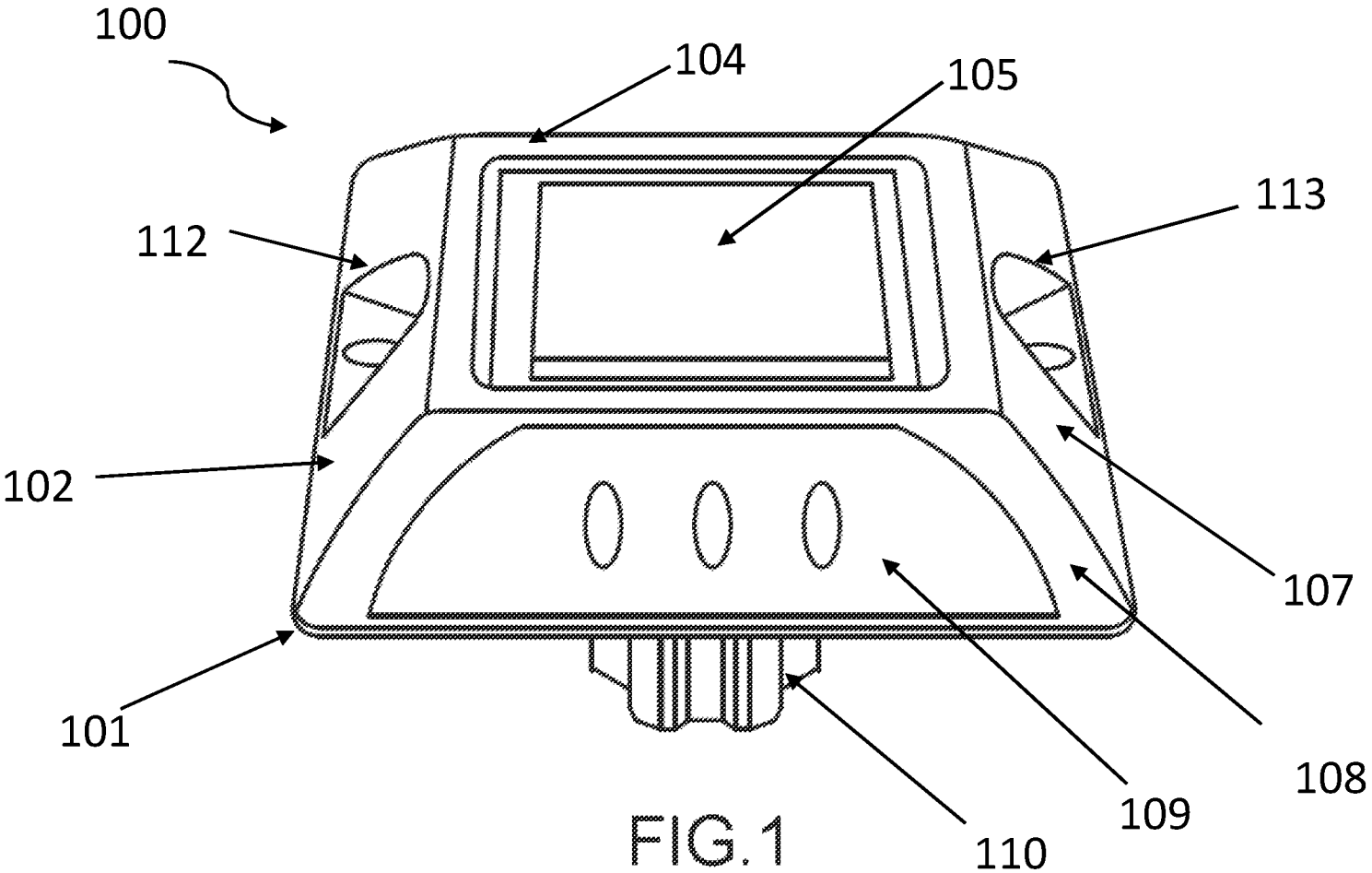
FIG. 1 is a perspective view of a conventional road marker.
Figure 2:
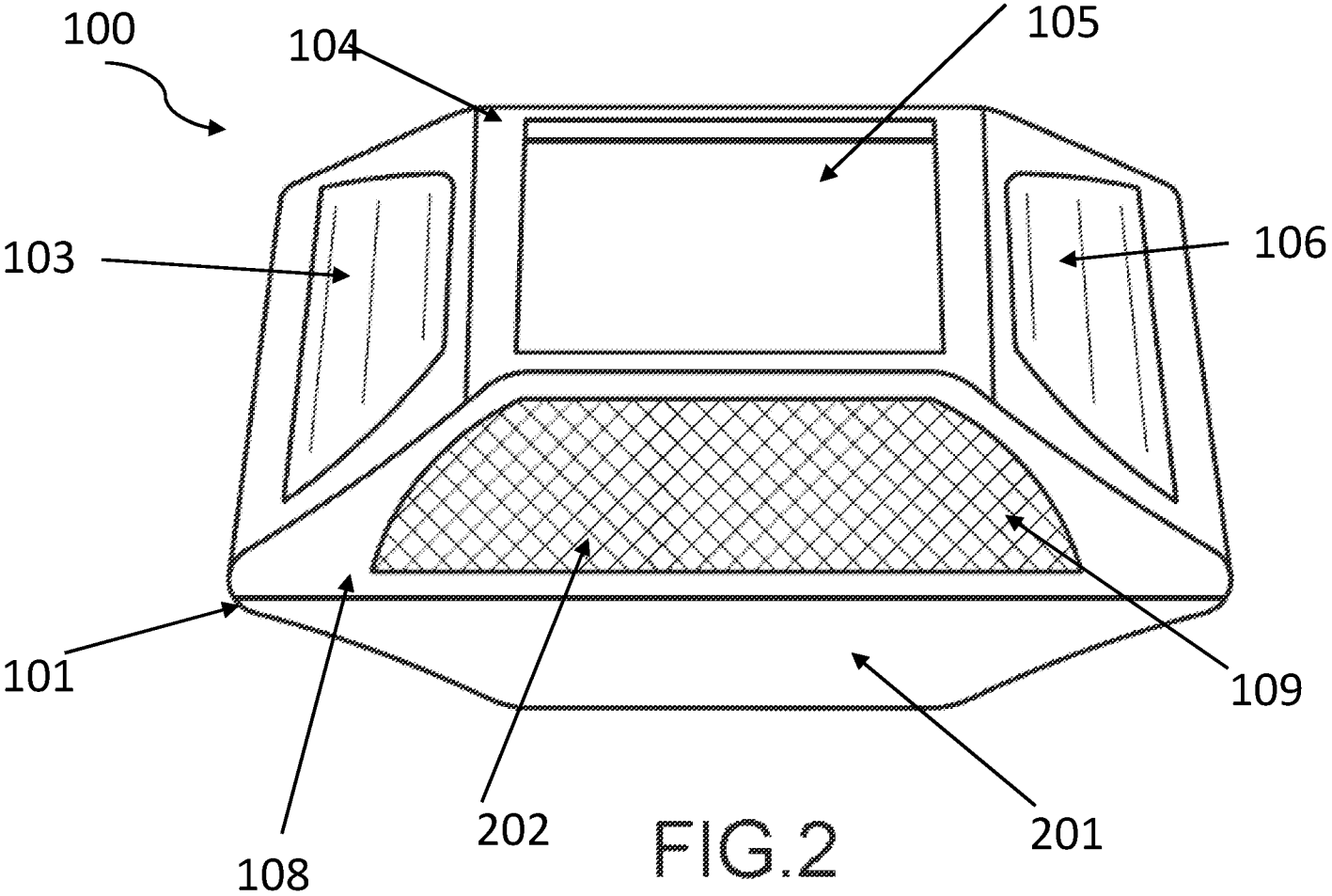
FIG. 2 is a perspective view of a road marker according to one embodiment of the invention.
Figure 3:
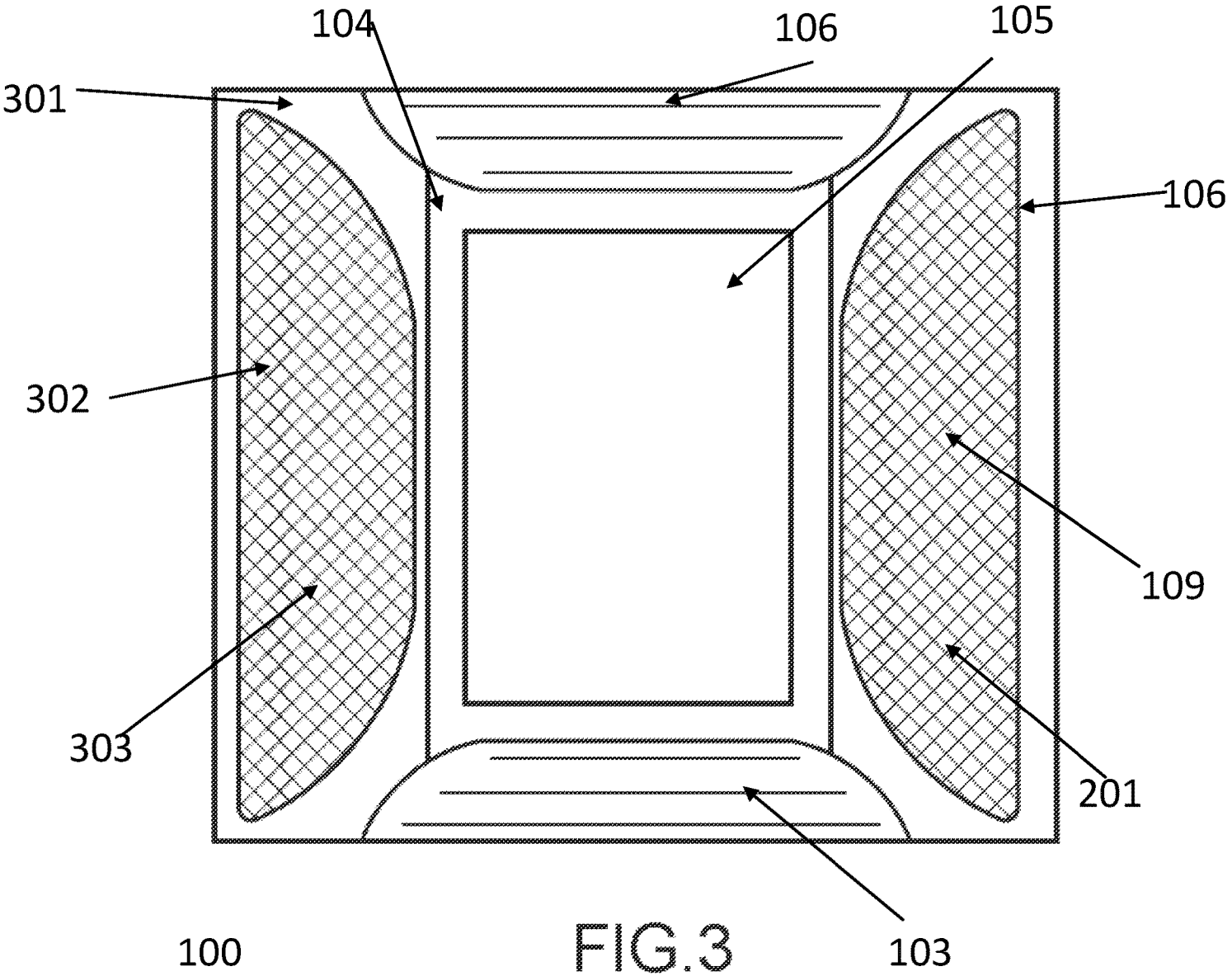
FIG. 3 is a top-view of a road marker according to one embodiment of the invention.
Figure 4:
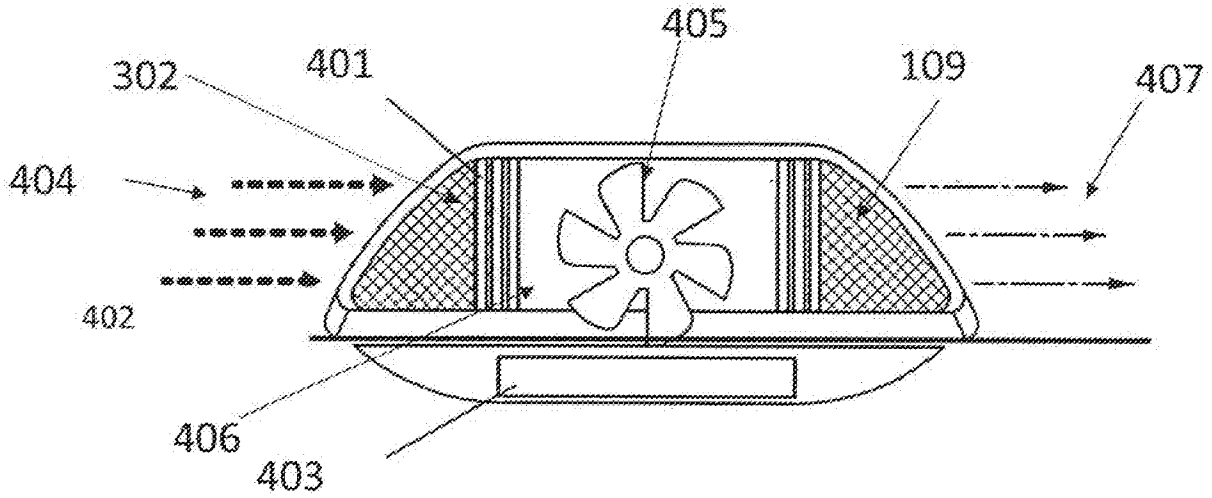
FIG. 4 is a cross-sectional view of a road marker according to one embodiment of the invention.

FIG. 1 shows a conventional road or raised pavement marker 100. FIGS. 2-4 illustrate an improved marker 100 according to one embodiment of the invention. The marker 100 may be rectangular in shape and comprised of conventional materials. The road marker may be in the form of any conventional geometric shape. The marker 100 may include a housing 101. The housing 101 may include sloped edges to allow traffic to drive smoothly over the marker 100. The housing 101 when mounted to a surface 601 may define at least one top surface 104, at least one bottom surface 201 and perimeter sides 102, 108, 107, 301, wherein the top surface 104, bottom surface 201 and perimeter sides, 102, 107, 108, 301 enclose a cavity 406. The cavity 406 may be accessible from the bottom surface 201 of the marker 100. The housing 101 may be formed as a single piece. Alternatively, the housing 101 may be formed from a plurality of individual pieces. The housing 101 may be formed from an abrasion-resistant material. The housing 101 may also be formed by 3D-printing or other conventional additive manufacturing processes.

The top surface 104 may include an opening 105 in which a PV module or solar panel (not shown) linked to a power source (not shown) may be fitted to the top surface 104. The bottom surface 201 may include an anchor 110 stemming from the bottom surface 201, which may be used to attach the marker 100 to a travel surface 601. The travel surface 601 may be roads, runways, driveways, bridges, parking lots, and the like. The anchor 110 may include an aperture (not shown) to hold one or more batteries 501 for supplying power to the housing 101.

The housing 101 may include at least one reflective surface of light-transmitting material 103, 106. The at least one reflective surface of light-transmitting material 103, 106 may be attached on opposite perimeter sides 102, 107 of the housing 101. Perimeter sides 102, 107 may be oriented in the direction of traffic on the travel surface 601. Perimeter sides 108, 301 may be oriented perpendicularly to the direction of traffic on the surface 601.

Figure 5:
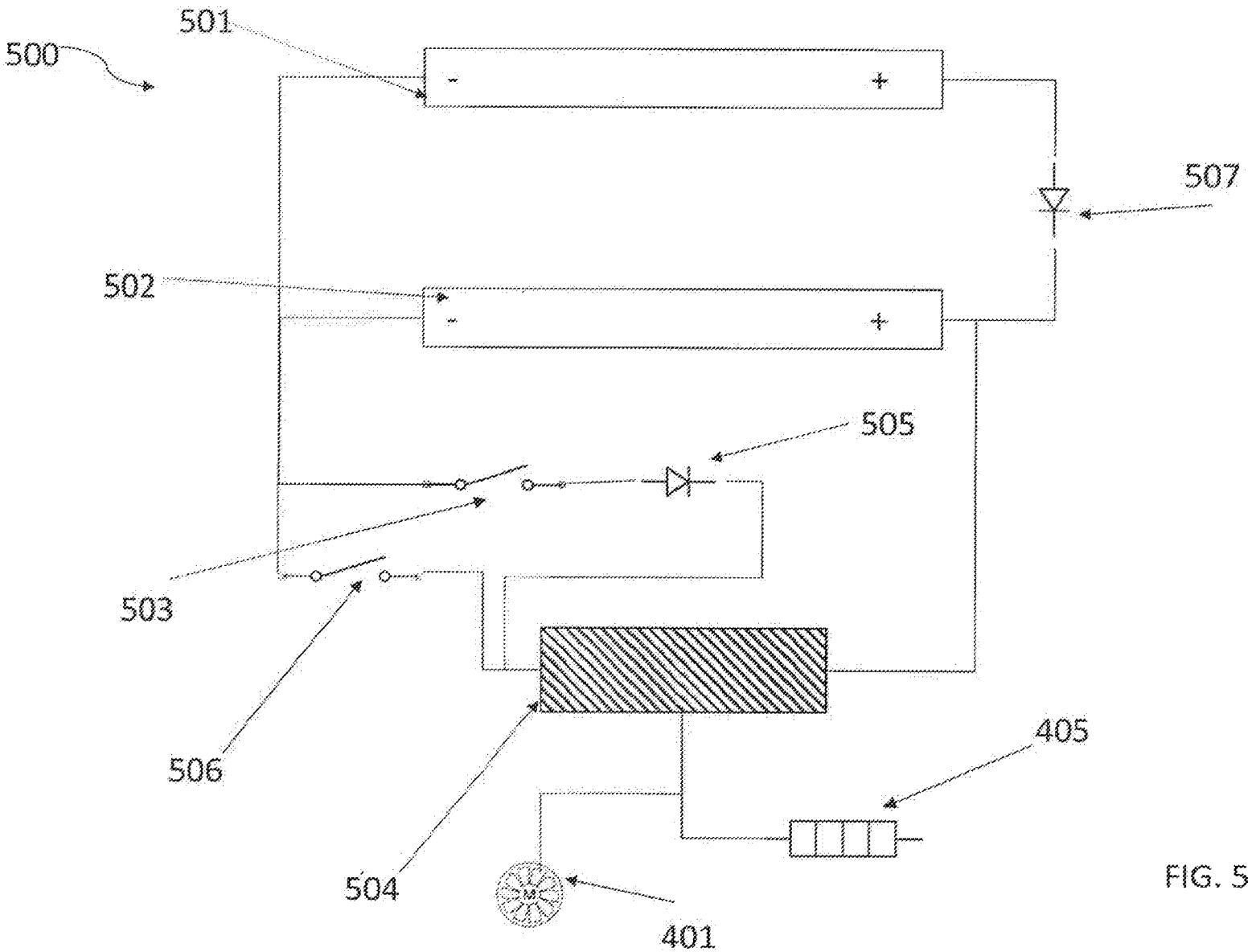
FIG. 5 is a simple schematic example of a circuit arrangement for a road marker according to one embodiment of the invention.

Perimeter sides 102, 107 may have an opening 103, 106 on each side. At least one mesh 202 may be affixed to each opening 112, 113. The mesh 202 may be comprised of a grid formed from metal or other conventional materials. The cavity 406 may contain a plurality of electronic components 500 (FIG. 5). The plurality of electronic components 500 may include a low temperature sense switch 503, a high temperature sense switch 506, a moisture sensor 505, a circuit board 504, a power source 403, a fan 405 and one or more heat elements 401.

The low temperature sense switch 503, which may be preferably a bi-metallic switch, may operable to close upon sensing a desired temperature in which snow may form. According to an example embodiment, the low temperature sense switch 503 may be part of a thermostat, and may be active during low or cool temperatures and de-activated during high or warm temperatures. In an example embodiment, only when the ambient temperature falls below a "critical" value close to 0° C. is there any danger of snow and ice forming. It can, however, also be assumed that no further ice formation takes place below a very low temperature, which, in the described exemplary embodiment, lies within a setting range of −5° C. to −20° C. The desired temperature may be between +4° and −20° C. The high temperature sense switch 506 may be preferably a bi-metallic switch, is operable to close upon sensing a high temperature in which snow or precipitation may not form. The desired high temperature may be greater or equal to +5° C. The low temperature sense switch 503 and the high temperature sense switch 506 may include a temperature sensitive diode, thermistor, digital thermometer or any other temperature sensor known to those skilled in the art. The low temperature sense switch 503 and the high temperature sense switch 506 may be contained within the bottom surface 201 of the housing 101. Alternatively, the low temperature sense switch 503 and the high temperature sense switch 506 may be contained either within the cavity 406 of the housing 101 or at the top surface 104 of the housing 101.

According to an example embodiment, placement of the low temperature sense switch 503 and the high temperature sense switch 506 may be to enable measurement of the ambient air temperature adjacent to the travel surface and/or marker 101. Air flow vents 109, 302 may be provided on opposite side of the housing 101 perimeter surfaces 102, 301 to provide additional circulating air flow the low temperature sense switch 503 and the high temperature sense switch 506. The low temperature sense switch 503 may be activated when the ambient temperature around the housing 101 falls below a first desired temperature value close to 0° C. The low temperature sense switch 503 may have at least approximately 0.75° C., or 1.0° C., or 1.5° C., or 2.0° C., or 2.5° C., or 3.0° C., or 3.5° C., or 4.0° C. of hysteresis to prevent rapid on/off cycling of the moisture sensor 505. The degree of hysteresis may be biased until at least 0.5° C. or higher than the high temperature, when temperature conditions may be suitably warmer than the temperature considered hazardous. The low temperature sense switch 503 and the high temperature sense switch 506 may 3 may be of any suitable design, including a resistor connected in a suitable sensing bridge circuit. The low temperature sense switch 503 may supply a signal to the circuit board 504 to indicate that the ambient temperature around the marker 100 is at the "critical" temperature range. The high temperature sense switch 506 may supply a signal to the circuit board 504 to indicate that the ambient temperature around the marker 100 is at the high temperature range. Although shown as two separate systems, in some alternatives, the low temperature sense switch 503 and the high temperature sense switch 506 may be a single system.

The moisture sensor 505 may be any conventional snow, humidity or other precipitation sensor. The moisture sensor 505 may include two moisture electrodes which are exposed to the exterior of the housing 101 and which react when they come into contact with ambient water or water from the travel surface. The moisture sensor 505 may have a sensing grid that generates a signal in the presence of moisture or water. The moisture sensor 505 may be disposed on the top surface 104 of the housing 101. The moisture sensor 505 may also be disposed within the cavity 406 of the housing 101. The moisture sensor 505 may contain a water sensor or water detector. When the moisture sensor 505 detects moisture or water in the ambient air, it may send a snow detection signal to the circuit board 504. In some alternatives, the low temperature sense switch 503 and the moisture sensor 505 may be separate systems. In some alternatives, low temperature sense switch 503 and the moisture sensor 505 may be combined into a single system. Both the low temperature sense switch 503 and moisture sensor 505 may be combined in a single housing with or without support electronics. Alternatively, they may be configured as separate sensors with or without the inclusion of support electronics. In an example embodiment, in the case of hard-wired electricity connection, the system may work without the moisture sensor 505 and by an operator for all of the devices. In addition, when the low-temperature sensor sends the low-temperature signals in a rainy day, the operator may turn them on by a switch from a control room.

A fan 405 may be disposed within the cavity 406 of the housing 101 for creating a flow of air through the air inlet 302 and out the air outlet 109. The fan 405 may include a fan motor and a fan blade disposed within the cavity 406 of the housing 101. The interior wall of the cavity 406 may direct the flow of air along the inward surface of the cavity 406 from the air inlet 302 to the air outlet 109. The fan 405 may be disposed adjacent the air inlet 302.

A heating element 401 may be interposed between the air inlet 302 and the air outlet 109 in such manner that the flow of air passes over the one or more heating elements 401 and is heated thereby. Although two heating elements 401 are shown in the drawings, one skilled in the art will appreciate that a single heating element or more heating elements may be provided in the airflow path in order to achieve a desired unit heating capacity. Heating elements 401 may be any type of conventional heating element.

The power source 403 of the marker 100 may comprise one or more batteries 501, and can use rechargeable batteries or those that are to be discarded. The power source 403 may be operably connected to the electronic components 500 within the housing 101. The power source 403 may comprise PV cells or modules 502, which may be used to recharge batteries 501, allowing for sunlight to provide power to the electronic components within the housing 101. Alternatively, the PV cells 502 may allow energy received from a car light or other light sources to provide power to the electronic components within the housing 101. In another embodiment, the power source 403 may provide electricity to the electronic components within the housing 101 through a hard-wired connection to a power-company grid source or an electrical connection. The PV module 502 used in the marker 100 may be located on the top surface 104 of the housing 101 when mounted to a surface so that it is exposed to light e.g. sunlight. The PV module 502 may be a solar panel of −0.1, or 0.2, or 0.5, or 0.75, or 1.0, or 1.25, or 1.5, or 1.75, or 2.0 volts. In another example embodiment, the PV module may be between 1.0 and 2.0 volt solar panel.

The circuit board 504 may be any conventional printed circuit board (PCB) with multiple inputs and outputs. The circuit board 504 used in the marker 100 may be configured to activate the fan 405 and heating element 401 when the low temperature sense switch 503 measures a temperature (ambient and/or substrate) approximate when ice may form (the predetermined temperature) and when the moisture sensor 505 detects moisture. The circuit board 504 used in the marker 104 may be configured to deactivate the fan 405 and heating element 401 when the high temperature sense switch 506 measures a temperature (ambient and/or substrate) above 1° C. or 2° C. or 3° C. or 4° C. or +5° C. Alternatively, the circuit board 504 may be a low voltage, resistor programmable thermostatic switch wherein the thermostatic switch may include at least a temperature-specific resistor, a temperature sensor, a power supply resistor, a ground terminal and an output terminal.

The marker 100 may be self-contained, (i.e., there may be no parts or components outside of the housing 101) which means that the marker 100 may be easy to manufacture, sell, ship and install and replace. In addition, certain embodiments may not need any substructure for installing.

Figure 6:
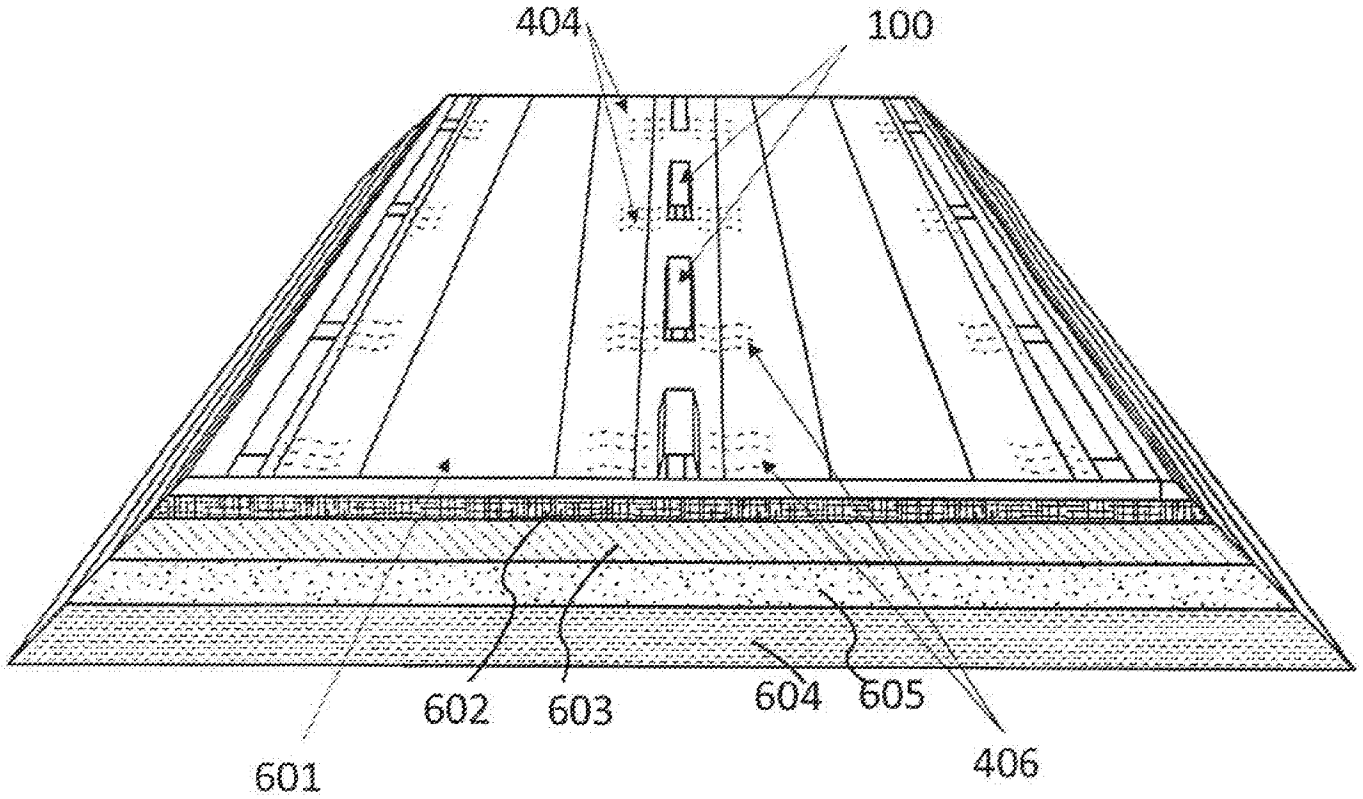
FIG. 6 is a top view of a surface with multiple road markers according to one embodiment of the invention.

FIG. 5 shows a simplified schematic of the electronic components 500 inside the housing 101 of the marker 100 according to one embodiment of the invention, and FIG. 6 illustrates a top view of a surface with road markers placement positions and their affected area on the road, according to another embodiment of the invention. The circuit of the electronic components 500 include a PV module 502 linked in parallel with a battery 501 and a circuit board 504. The connection between the PV module 502 and the battery 501 includes a one-way diode 506 preventing reverse flow of electricity thus avoiding draining of the battery 501. The circuit of the electronic components includes at least two switches, the first being a low temperature sense switch 503 and the second being a high temperature sense switch 506. The circuit may also include input from a moisture sensor 505. The circuit of the electronic components 500 links to a fan 405 and one or more heat elements 401.

In operation, the solar panel 502 generates at least 120 miW charge to the circuit board 504. According to certain example embodiments, the needed energy of the circuit may be approximately 200 mW. In the event of no light energy, the battery 501 may provide power to the circuit board 504. In addition, the battery 102 may have a power output of approximately 1.5V to 6.0V. When the low temperature sense switch 503 detects an ambient or travel surface 601 temperature in the predetermined temperature range, it may close and activate the moisture sensor 505. The moisture sensor 505 may monitor the ambient temperature and travel surface 601 within proximity of the marker 100 for water at predetermined intervals. The predetermined intervals, may be for example, at 5, 10, 15, 20, 30, 40 and 60 minute increments, or for longer periods, such as for example, every 2, 4, 6 8 and 10 hours. According to certain example embodiments, the moisture sensor 505 may operate periodically and work by time periods. However, in other example embodiments, the moisture sensor 505 may be continuous. In the case of using separate sensors, it may be better to be periodic. In other example embodiments, for energy saving, the moisture sensor 505 may be deactivated while the low-temperature sensor is deactivated. With the activation of the low-temperature sensor, the moisture sensor 505 may work periodically. However, in the case of a unique sensor, the moisture sensor 505 may detect data that is continuous with the max energy consuming of about 300 μA.

When the moisture sensor 505 detects the presence of water or moisture, it may generate a signal, which may then be transmitted to the circuit board 504. In response, the circuit board 504 may activate the fan 405 and the one or more heat elements 401. The fan 405 may be oriented in such manner that the fan 405 draws air through air inlet 302 and directs the drawn air 404 along the cavity 406 walls of the housing 101 cavity, passing over heating element 401, which preferably includes a coiled resistive element, and exiting the housing 101 through the air outlet 109 as heated air 407. When the high temperature sense switch 506 (one-way diode) detects a high temperature, it may close and sense a signal to the circuit board 504 to deactivate the fan 405 and the one or more heating elements 401. Alternatively, at preset intervals, the circuit board 504 may deactivate the fan 405 and the one or more heat elements 401 based on a user set criteria. For instance, in certain embodiments, the fan and heat elements may be working together and may turn on or off together. In addition, they may be connected to the temperature sensors. According to such a configuration, the fan and heat elements may turn on by activating both the low-temperature and moisture sensor (rain alarm).

The electronic components 500 described above may be passive components. This may be important to reduce the energy requirements of the circuit board 504 and therefore reduce costs and maintenance requirements. The electronic components 500 as a whole may be selected to minimize the voltage requirement to less than 6 volts. The voltage may be minimized to a voltage requirement of less than 6 volts, 4 volts, 2 volts, or 1.5 volts. An aim of minimizing the voltage requirement is that the marker 100 can be made from simple components requiring little maintenance. These low voltage requirements may also serve to extend the battery 501 life of the marker 100. According to certain example embodiments, the circuit and sensors may be working by the power of the battery 501, which may have been charged with the solar power. In an example embodiment, when both of the low-temperature sensor and moisture sensor 505 detects snow, the data may be sent to the controller, and the controller may switch the heater and the fan on. According to an example embodiment, this part may function with wired electricity.

It should be apparent from the foregoing that an invention having significant advantages has been provided. While the invention is shown in only a few of its forms, it is not just limited but is susceptible to various changes and modifications without departing from the spirit thereof.

We claim:

1. A road marker, including a housing with a cavity and at least one two perimeter surfaces oriented perpendicular to the direction of traffic, each of the at least two perimeter surfaces containing an opening substantially covered with a mesh, each of the openings forming either an air input or an air output, said air input and air output openings lying substantially opposite to each other to generate a flow of air through the cavity, the cavity comprising passive electrical components for heating the flow of air, comprising:

(a) a circuit board with a plurality of terminals;

(b) a power source coupled to a first input terminal for powering the passive electrical components;

(c) a low temperature bi-metallic sense switch electrically connected to a moisture sensor, the moisture sensor electrically coupled to a second input terminal, wherein the low temperature bi-metallic sense switch is operable to close upon sensing a predetermined temperature range and to activate the moisture sensor, and wherein when water is detected in an ambient environment around the marker, the moisture sensor is operable to generate a second signal that is transmitted to the circuit board;

(d) a fan arranged within the cavity between the air input and the air output openings, which is connected to a first output terminal, wherein the fan receives a first activation signal from the circuit board, and wherein the fan is operable to draw a flow of air into the housing through the air input into the cavity;

(e) one or more heating elements arranged on opposite sides of the fan within the housing, which are connected to a second output terminal, wherein the one or more heating elements receives a second activation signal from the circuit board and wherein the heating element heats the air flow as it exits the housing through the air output opening; and (f) a high temperature bi-metallic sense switch electrically connected to a third input and operable to close upon sensing a high temperature and to send a signal to the circuit board for deactivating the fan and the one or more heating elements.

2. The marker of claim 1, wherein the predetermined temperature range is between 0° C. and −20° C.

3. The marker of claim 1, wherein the high temperature is greater than +40° C.

4. The marker of claim 1, wherein the first activation signal and the second activation signal are activated for a predetermined period of time set by a user or activated automatically.

5. The marker of claim 4, wherein the predetermined period of time is selected from a group consisting of, 5 minutes, 10 minutes, 15 minutes, 20 minutes, 30 minutes, 40 minutes, 60 minutes, 2 hours, 4 hours, 6 hours, 8 hours, 10 hours and combinations therein.

6. The marker of claim 1, wherein the power source is selected from a battery, a rechargeable DC battery, a photovoltaic array or alternating current source.

7. The roadway marker of claim 1, wherein the moisture sensor is configured to sense precipitation selected from a group consisting of snow, ice, freezing rain or sleet.

* * * * *